US005850874A

United States Patent [19]

Burge et al.

[11] Patent Number: 5,850,874

[45] Date of Patent: Dec. 22, 1998

[54] DRILLING SYSTEM WITH ELECTRICALLY CONTROLLED TUBING INJECTION SYSTEM

[76] Inventors: Philip Burge, 1 Russell Close, Chiswick, London W4 2NU; Peter Fontana, 35 Drayton Court, Drayton Gardens, London SW10; Glenn Leroux, 24 Rodway Road, Roehampton, London, SW15, all of England; Friedhelm Makhol, Weesener Strasse 38, 20320 Hermannsburg, Germany

[21] Appl. No.: 635,114

[22] Filed: Apr. 19, 1996

Related U.S. Application Data

[63] Continuation-in-part of Ser. No. 402,117, Mar. 10, 1995, abandoned, Ser. No. 524,984, Sep. 8, 1995, abandoned, Ser. No. 543,683, Oct. 16, 1995, abandoned, and Ser. No. 600, 842, Feb. 13, 1996, Pat. No. 5,738,173.

[51] Int. Cl.[6] ..... E21B 14/22

[52] U.S. Cl. ..... 166/77.3

[58] Field of Search ..... 166/77.2, 77.3, 166/384, 385

[56] References Cited

U.S. PATENT DOCUMENTS

| | | |
|---|---|---|
| 3,638,288 | 2/1972 | Pryor . |
| 3,872,932 | 3/1975 | Gosselin . |
| 4,154,310 | 5/1979 | Konstantinovsky . |
| 4,463,814 | 8/1984 | Horstmeyer et al. . |
| 4,515,220 | 5/1985 | Sizer et al. . |

(List continued on next page.)

FOREIGN PATENT DOCUMENTS

| | | | |
|---|---|---|---|
| 890228 | 1/1972 | Canada | 166/77.3 |
| 1059932 | 2/1967 | France . | |
| 1189033 | 3/1965 | Germany | 166/77.3 |
| 1 945 590 | 3/1970 | Germany . | |
| 1107493 | 3/1968 | United Kingdom . | |
| 2 247 260 | 2/1992 | United Kingdom . | |
| WO 96/00359 | 1/1996 | WIPO . | |
| WO 96/28633 | 9/1996 | WIPO . | |

OTHER PUBLICATIONS

"Flexdrill development nears successful completion." *World Oil,* pp. 127–130, 133 (Jul. 1977).

"Shell pressing coiled tubing programs in California." *Oil & Gas Journal,* pp. 31–32 (Jun. 27, 1994).

Phil Burge "Modular Rig System — Advances in CTD/SJD Rigs." *2nd European Coiled Tubing Roundtable SPE Aberdeen Section + ICoTA* (17–18 Oct. 1995).

"Use of coiled tubing fans out among well sites of the world." *Oil & Gas Journal,* pp. 18–25, (Oct. 3, 1994).

*Primary Examiner*—William P. Neuder
*Attorney, Agent, or Firm*—Madan & Morris, PLLC

[57] ABSTRACT

The present invention provides a drilling rig which includes an electrically-controllable tubing injection system. The injection system contains a fixed injector head with two movable injection blocks which are remotely operable to provide a desired opening therebetween. Each injection block contains a plurality of gripping members for holding a range of tubing sizes. The injection blocks automatically adjust to provide the required gripping force and tubing speed according to programmed instructions. A resilient tubing guidance system is positioned above the injector head directs the tubing into the injector head. The rig system contains sensors for determining the radial force on the tubing exerted by the injector head, tubing speed, injector head speed, weight-on-bit during the drilling operations, bulk weight of the drill string, compression of the tubing guidance memeber during operations and the back tension on the tubing reel. During operations, a control unit continually maintains the tubing speed, tension on chains in the injector head, radial pressure on the tubing within predetermined limits. Additionally, the control unit maintains the back tension on the reel and the position of the tubing guidance system within their respective predetermined limits. The control unit also controls the operation of the wellhead equipment. During removal of the tubing from the wellbore, the control unit operates the reel and the injector head to remove the tubing from the wellbore.

29 Claims, 3 Drawing Sheets

U.S. PATENT DOCUMENTS

| | | | |
|---|---|---|---|
| 4,585,061 | 4/1986 | Lyons et al. . | |
| 4,655,291 | 4/1987 | Cox . | |
| 4,735,270 | 4/1988 | Fenyvesi | 166/77.3 X |
| 5,002,130 | 3/1991 | Laky . | |
| 5,094,340 | 3/1992 | Avakov . | |
| 5,215,151 | 6/1993 | Smith et al. . | |
| 5,234,053 | 8/1993 | Connell . | |
| 5,244,046 | 9/1993 | Council et al. . | |
| 5,287,921 | 2/1994 | Blount et al. . | |
| 5,291,956 | 3/1994 | Mueller et al. . | |
| 5,309,990 | 5/1994 | Lance | 166/77.3 |
| 5,311,952 | 5/1994 | Eddison et al. . | |
| 5,339,913 | 8/1994 | Rives . | |
| 5,553,668 | 9/1996 | Council et al. | 166/77.3 |

140
146
156
110
152
150
154a
154b
144a
144b
142
148
h
130
200
270
163
165
122
124
162'
20
12
118
142
162
186
119
160
170
TUBING REEL
184
114
HYDRAULIC POWER UNIT
CONTROL SYSTEM (UNIT)
164
116
162
180

DRILLING SYSTEM WITH ELECTRICALLY CONTROLLED TUBING INJECTION SYSTEM

CROSS REFERENCE TO RELATED APPLICATIONS

This application is a continuation-in-part of the U.S. Pat. application Ser. Nos. 08/402,117, filed Mar. 10, 1995, now abandoned; 08/524,984, filed on Sep. 8, 1995, now abandoned; 08/543,683, filed on Oct. 16, 1995, now abandoned; provisional application Serial No. 60/007,229, filed on Nov. 3, 1995; and U.S. patent application Ser. No. 08/600,842, filed Feb. 13, 1996, which issued as U.S. Pat. No. 5,738,173.

BACKGROUND OF THE INVENTION

1. Field of the Invention

This invention relates generally to drilling systems for drilling wellbores and more particularly to drilling system having (a) a remotely and automatically controllable tubing injection system for running different types of tubings into the wellbore, (b) an automatically controllable wellhead equipment and (c) a tubing guidance system which imparts less stress into the tubing compared to goosenecks typically utilized for passing the tubing fromt a tubing reel to an injector head.

2. Background of the Art

Drilling rigs and workover rigs are utilized to run into wellbores a drill pipe, production pipe or casing during the drilling or servicing operations. Such rigs are expensive and the drilling and service operations are time-consuming. To reduce or minimize the time and expense involved in using jointed pipes or jointed tubing, operators often use coiled tubing instead for performing drilling and/or workover operations.

During the early applications of such coiled tubing use, smaller diameter coiled tubing, typically approximately one inch, was used. Use of the smaller diameter coiled tubing limits the amount of fluid flow therethrough, amount of compression force that can be transmitted through the tubing to the bottomhole assembly, amount of tension that can be placed on the tubing, amount of torque that the tubing can withstand, type and weight of the tools that can be utilized to perform drilling or servicing operations, and the length of the tubing that can be used.

Due to improvements in the materials used for making the tubings and improvement in the tubing-handling equipment, coiled tubings of varying sizes are now used, including coiled tubing greater that three inches in outside diameter. However, the design of the rigs, injector systems, especially the injector heads, and the equipment for handling the tubing from a tubing reel to the injector head are still typically designed to run a specific tubing size. Additionally, most of the operations of the injector head, tubing reel and wellhead equipment are manually performed by operators who respond to visual gauges to operate a variety of control valves that direct hydraulic power to different elements of the injector head, tubing reel and the wellhead equipment.

Additionally, the injector head is typically placed on the wellhead equipment. To attach a bottomhole assembly such as a drilling assembly, the injector head is removed from the wellhead equipment to insert the bottomhole assembly into the wellhead equipment. U.S. patent application Ser. No. 08/600,842, filed on Feb. 13, 1996, titled "Universal Pipe Tubing Injection Apparatus And Method," by the inventors of this application, which is incorporated herein by reference, discloses injector head and gooseneck systems which alleviate many of the problems with the prior art systems. This application discloses systems having vertically-movable injector head and gooseneck, which allow the operator to connect and disconnect the bottomhole assembly to the tubing on a working platform.

Some of the above-described systems still require moving the injector head from its operating position whenever a relatively larger diameter bottomhole assembly is to be inserted into a wellbore through the wellhead equipment. These systems also do not provide an injector head that allows the passage of both tubings and bottomhole assemblies of a variety of sizes to pass through the injector head when the bottomhole assembly is already connected to the tubing.

Additionally, the injector heads utilized in the systems discussed above, typically bite into the tubing and frequently induce undue radial stress into the tubing which either results in reducing the useful life of the tubing or damaging the tubing during operations. In some cases, the damage forces the operations to cease in order to replace the tubing, which generally proves quite expensive.

Also, in the above-mentioned systems, the tubing is unwound from a reel and passed over a gooseneck, which is a rigid structure of a relatively short radius. Such goosenecks impart great stress onto the tubing when the tubing is passed from a tubing reel into the injector head. Also, such systems utilize manual systems for controlling the back tension on the tubing at the reel. These manual methods are imprecise resulting in inducing excessive stress in the tubing.

It is, therefore, desirable to have a rig wherein the injector head is fixedly attached to the wellhead equipment such that it will allow the passage of a wide range of bottomhole assemblies through the injector head and wherein the injector head can then be used to inject the tubing into and remove the tubing from the wellbore having a range of outside diameter without the necessity of removing the injector head. It is further desirable to have an injector head which can securely grip the tubing without inducing undue radial stress into the tubing or damaging the tubing.

In addition to the above-noted deficiencies of the prior art rigs, operations of the injector head and the wellhead equipment, such as the blowout preventor, are controlled manually by several operators. These operators adjust a variety of hydraulic control valves to adjust various operating parameters, such as the gripping pressure applied by the injector head on the tubing, the injector head speed, the back-tension on the tubing at the reel, and the operation of the BOP. Some rigs require several operators who must be stationed at different locations at the rig to control the various operations of the injector head, reel and the wellhead equipment. Such manually controlled hydraulic operations are imprecise, exceptionally labor intensive, relatively inefficient, and detrimental to the long life of the equipment, especially the coiled tubing.

It is, therefore, highly desirable to have a rig wherein certain operating parameters relating to the various equipment, such as the injector head, tubing reel and the wellhead equipment, are remotely and automatically controlled to provide a more efficient and safer rig operations. It is further desirable to provide a safe working area away from the injector head for the operator to connect and disconnect the bottomhole equipment to the tubing and to pass such equipment through the injector head without moving the injector head or the gooseneck.

As noted earlier, goosenecks are typically rigid and are fixedly attached to the rig above the injector head. Such goosenecks tend to impart great stress to the coiled tubing when the tubing is passed thereon during the insertion or removal of the coiled tubing. It is therefore desirable to have a system that will impart less stress into the tubing during the insertion and removal of the tubing operations.

The present invention addresses the above-noted problems and provides a rig having a novel tubing insertion and removal system which handles a relatively large range of tubing diameters, allows the passage of the bottomhole assemblies through the injector head without the need to remove or move the injector head, automatically controls certain parameters relating to the tubing injection system, tubing reel and wellhead equipment, provides information about such and other parameters to a remote location, provides a safe working area for connecting and disconnecting the bottomhole assembly from the tubing and further provides a tubing guidance system for passing the tubing from the tubing reel to the injector head which imparts substantially less stress into the tubing compared to typically used goosenecks.

SUMMARY OF THE INVENTION

The present invention provides a rig which includes an electrically controllable injection system from a remote location. The injection system contains at least two opposing injection blocks which are movable relative to each other. Each such injection block contains a plurality of gripping members. Each gripping member is designed to accommodate removable Y-blocks that are designed for specific tubing size. The injector head is placed on a platform above the wellhead equipment. A plurality of rams are coupled to the injector head for adjusting the width of the opening between the injection blocks and for providing a predetermined gripping force to the holding blocks. The rams are preferably hydraulically operated. A tubing guidance system is positioned above the injector head for directing a tubing into the injector head opening in a substantially vertical direction. The rig system contains a variety of sensors for determining values of various operating parameters. The system contains sensors for determining the radial force on the tubing exerted by the injector head, tubing speed, injector head speed, weight on bit during the drilling operations, bulk weight of the drill string, compression of the tubing guidance member during operations and the back tension on the tubing reel.

With respect to the operation of the injector head, during normal operation when the tubing is inserted into the wellbore, the control unit continually maintains the tubing speed, tension on chains in the injector head and radial pressure on the tubing within predetermined limits provided to the control unit. Additionally, the control unit maintains the back tension on the reel and the position of the tubing guidance system within their respective predetermined limits. The control unit also controls the operation of the wellhead equipment. During removal of the tubing from the wellbore, the control unit operates the reel and the injector head to remove the tubing from the wellbore. Thus, in one mode of operation, the system of the invention automatically performs the tubing injection or removal operations for the specified tubing according to programmed instruction.

The rig system of the present invention requires substantially less manpower to operate in contrast to comparable conventional rigs. The bottom hole assembly is safely connected from the tubing at a working platform prior to inserting the bottomhole assembly into the injector head and is then disconnected after the bottom hole assembly has been safely removed from the wellbore to the working platform above the injector head. This system does not require removing or moving either the tubing guidance system or the injector head as required by the prior art systems. The injector head is fixed above the wellhead equipment, which is safer compared to the system which require moving the injector head. Substantially all of the operation is performed from the control unit which is conveniently located at a safe distance from the rig frame, thus providing a relatively safer working environment. The operations are automated, thereby requiring substantially fewer persons to operate the rig system.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION OF PREFERRED EMBODIMENTS

Figure 1:
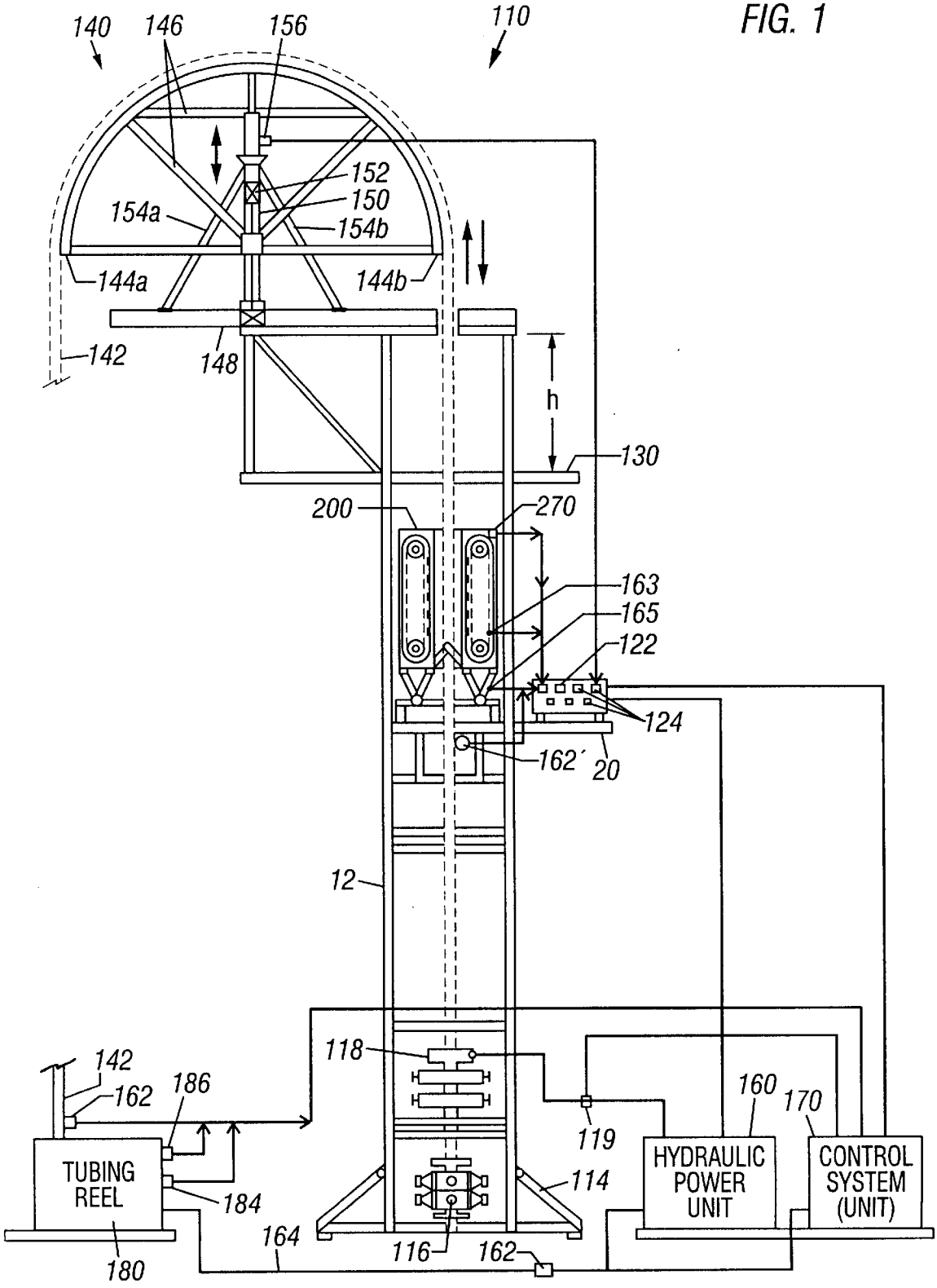
FIG. 1 shows a schematic elevational view of a drilling rig and the control systems according to the present invention.
Figure 2:
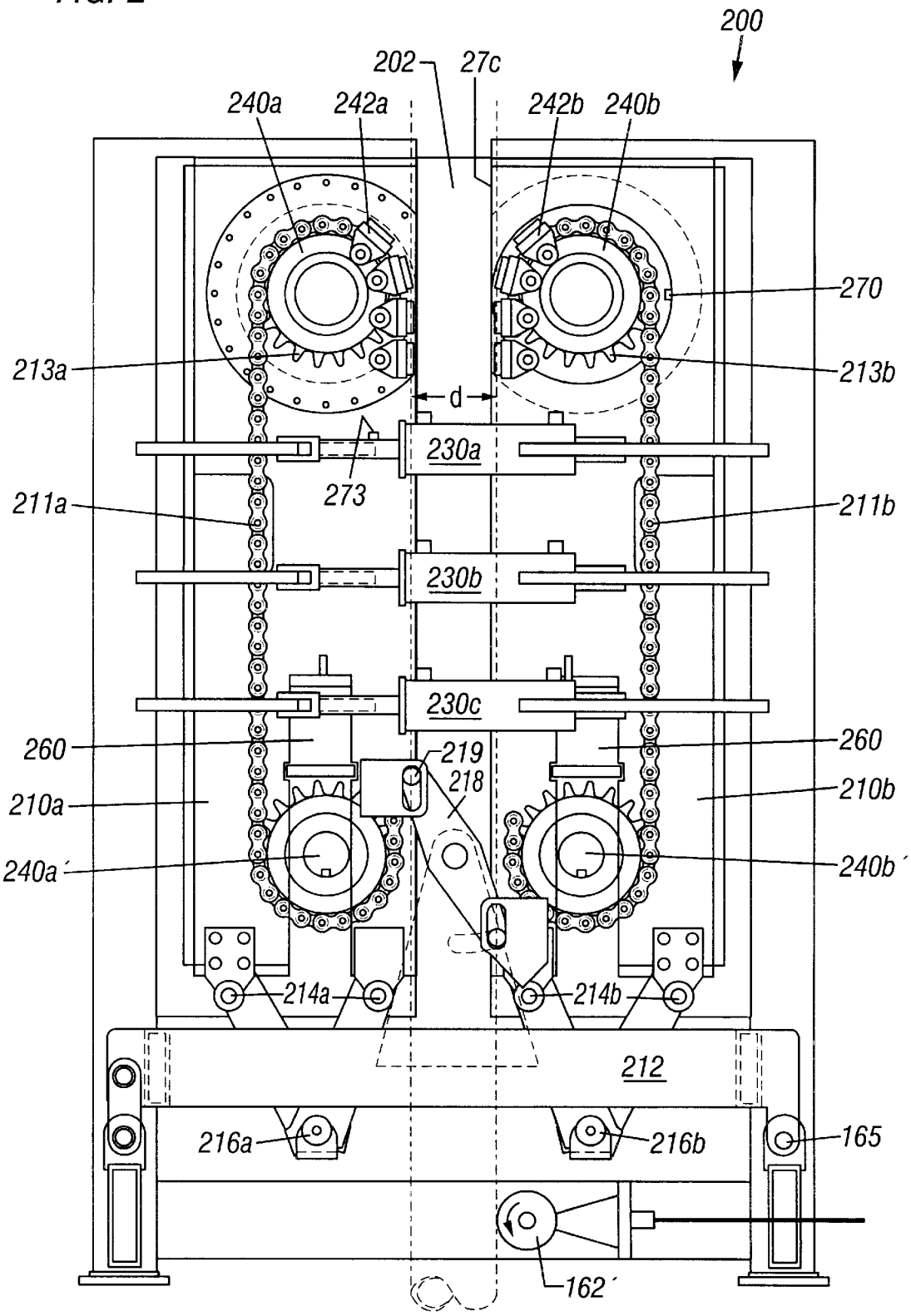
FIG. 2 shows a schematic elevational view of an injector head according the present invention for use with the rig shown in FIG. 1.

FIG. 1 shows a schematic elevational view of a rig 100 according to the present invention. The rig 100 includes a substantially vertical frame rig 112 placed on a base 114. A suitable wellhead equipment containing wellhead stack 116 and a blowout preventor stack 118, known in the art, are placed as desired over the well casing (not shown) which is placed over the wellbore. A first platform or injector head platform 120 is provided at a suitable height above the wellhead equipment 116 and 118. An injector head, generally denoted herein by numeral 200 and described in more detail later in reference to FIG. 2, is fixedly attached to the injector head platform 120 directly above the wellhead equipment. A control panel 122 for controlling the operation of the injector head is preferably placed on the injector head platform 120 near the injector head 200. The control panel 122 preferably contains electrically operated control valves 124 for controlling the various operations of the injector head 200. The control valves 124 control the flow of a pressurized fluid from a common hydraulic power system 160 placed at a remote location to the valves' associated operating elements, as described in more detail later in reference to FIG. 2. An electrical control system or control unit 170 placed at a remote location is provided to control the operation of the injector head 200 and other elements of the rig 100 according to programmed instructions or models provided to the control unit 170. The detailed description of the injector head 200 and the operation of the rig 100 are described later.

Still referring to FIG. 1, the rig 100 further contains a working platform 130 that is attached to the frame 112 above the injector head 200. Tubing 142 to be used for performing the drilling, workover or other desired operations is coiled on a tubing reel 180. The reel 180 is preferably hydraulically operated and is controlled by the electrical control unit 170. The control unit 170 controls a fluid control valve 162 placed in a fluid line 164 coupled between the reel 180 and the hydraulic power unit 160. A sensor 182, preferably a wheel-type sensor known in the art, is operatively coupled to the tubing near the reel. The output of the sensor 182 is passed to the electrical control unit 170, which determines the speed of the tubing in either direction. A sensor 184 is coupled to the reel for providing the reel rotational speed. A tension sensor 186 is coupled to the reel 180 for determining the back tension on the tubing 142.

The tubing 142 from the reel 180 passes over a tubing guidance system, generally denoted herein by numeral 140, which guides the tubing 142 from the reel 180 into the injector head 200. The tubing guidance system 140 is attached to the frame 112 at a height "h" above the working platform 130 which is sufficient to enable an operator to connect and disconnect the required downhole equipment to the tubing 142. The tubing guidance system 140 preferably contains a 180° guide arch 144 having a relatively large radius. A radius of about fifteen (15) feet has been determined to be suitable for coiled tubing with outside diameter between one inch and three and one half inches. The front end 144*a* of the guide arch 144 is preferably positioned directly above a reel 180 on which the tubing is wound and the tail end 144*b* is positioned above an opening 272 of the injector head 200 so that the tubing 142 will enter the injector head opening 272 vertically. The guide arch 144 is supported by a rigid arch frame 146, which is placed on a horizontal support memeber 148 by a flexible connection system 150. The flexible connection system 150 contains a piston 152 that is connected between the arch guide 144 and the member 148. Members 154*a* and 154*b* are fixedly connected to the piston 152 and pivotly connected the horizontal member 148. In this configuration, during operations, as the weight or tension on the guide arch 144 varies, the piston 152 enables the guide system 140 to accordingly move vertically. The large radius and the piston arrangement makes the guidance system 140 resilient, thereby avoiding excessive stress on the coiled tubing. This system has been found to improve the life of the coiled tubing by about thirty percent (30%) compared to the fixed gooseneck systems commonly used in the oil industry. A position sensor 156 is coupled to the piston 152 to determine the position of the arch relative to its original or non-operating position, i.e., when the system is not in use. During operation, the control unit 170 continually determines the position of the guide arch 144 from the sensor 156. The control unit 170 is programmed to activate an alarm and/or shut down the operation when the guide arch 144 has moved downward beyond a predetermined position. The guide arch position correlates to the stress on the guide arch 144.

All of the hydraulically operable elements of the wellhead equipment 116 and 118 are coupled to the hydraulic power unit 160, including the blowout preventor 118. For each such hydraulically operated element, an electrically operable control valve, such as valve 119 or 124, is placed in an associated line, such as line 121 connected between the element and the hydraulic power unit 160. Each such control valve is operatively coupled to the control unit 170, which controls the operation of the control valve according to programmed instructions. In addition, the control unit 170 may be coupled to a variety of other sensors, such as pressure and temperature sensors for determining the pressure and temperature downhole and at the wellhead equipment. The control unit 170 is programmed to operate such elements in a manner that will close the wellhead equipment when an unsafe condition is detected by the control unit 170.

For purposes of clarity, the function and operation of the injector head 200 will now be described before describing the operation of the rig 100. FIG. 2 shows a schematic elevational view of an embodiment of the injector head 200 according to the present invention. The injector head 200 contains two vertically placed opposing blocks 210*a* and 210*b* that are movable with respect to each other in a substantially horizontal direction so as to provide a selective opening 272 of width "d" therebetween. The lower end of the block 210*a* is placed on a horizontal support member 212 supported by upper rollers 214*a* and a lower roller 216*a*. Similarly, the lower end of the block 210*b* is placed on a horizontal support member 212 supported by upper rollers 214*b* and a lower roller 216*b*. The blocks 210*a* and 210*b* are pivotly connected to each other at a pivot point 219 by pivot members 218 in a manner that enables the blocks to move horizontally, thereby creating a desired opening of width "d" between such blocks. A plurality of hydraulically-operated members 230*a–c* (RAM) are attached to the blocks 210*a–b* for adjusting the width "d" of the opening 272 to a desired amount. The RAMS 230*a–c* are operatively coupled via a control valve 124 placed in the control panel 122 to the hydraulic power unit 160. The control unit 170 controls the RAM action. The RAMS 230*a–c* are all operated in unison so as to exert substantially uniform force on the blocks 210*a* and 210*b*.

Injector block 210*a* preferably contains an upper wheel 240*a* and a lower wheel 240*a*', which are rotated by a chain 211*a* connected to teeth 213*a* and 213*b* of the wheels 240*a* and 240*b* respectively. The upper wheel 240*a* contains a plurality of tubing holding blocks 242*a* attached around the circumference of the upper wheel 240*a*. Similarly, injector block 210*b* contains an upper wheel 240*b* and a lower wheel 240*b*', which are rotated by a chain 211*b* connected to the teeth of such wheels. The upper wheel 240*b* contains a plurality of tubing holding blocks 242*b* attached around the circumference of the upper wheel 240*b*. The wheels 240*a* and 240*b* are rotated in unison by a suitable variable speed motor (not shown) whose operation is controlled by the control unit 170. Each block 242*a* and 242*b* is adapted to receive a Y-block therein, which is designed for holding or gripping a specific tubing size or a narrow range of tubing sizes. Additionally, a separate vertically operating RAM 260 is connected to each of the lower wheels for maintaining a desired tension on their associated chains. The RAMS 260 are preferably hydraulically-operated and electrically-controlled by the control unit 170.

Figure 3A:
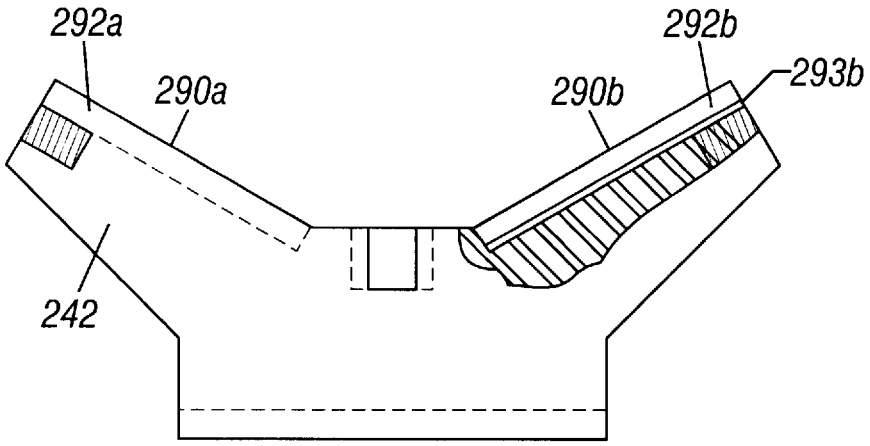
FIG. 3A shows a side view of a block having a resilient member for use in the injector head of FIG. 2.
Figure 3B:
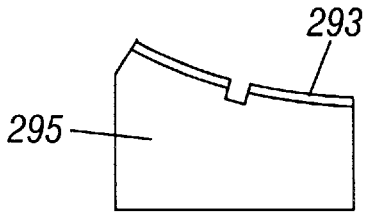
FIG. 3B shows a side view of a gripping member for use in the block of FIG. 3A.

FIG. 3A shows a side view of an injection tubing holding block 242, such as blocks 242*a–b* shown in FIG. 1. FIG. 3B shows a side view of a holding member 295 for use in the block 242. The block 242 is "Y-shaped" having outer surfaces 290*a* and 290*b* which respectively have therein receptacles 292*a* and 292*b* for receiving therein the tubing holding member 295. Each surface of the Y-block 242 contains a resilient member, such as member 293*b* shown placed in the surface 292*b*. The outer surface of the holding member 295 may contain a rough surface or teeth for providing friction thereto for holding the tubing 242. A separate holding member 295 is placed in each of the outer surfaces of the Y-block 242 over the resilient member. The Y-blocks are fixedly attached to the upper wheels 240*a–b* around their respective circumferences as previously described. During operations, the Y-blocks are urged against the tubing, which causes the holding members 295 to somewhat bite into the tubing 142 to provide sufficient gripping action. As the wheels 240*a–b* rotate, the Y-blocks grip the tubing and move the tubing in the direction of rotation of the wheels. If the tubing has irregular surfaces or relatively small joints, the resilient members provide sufficient flexibility to the holding members to adjust to the changing contour of the tubing without sacrificing the gripping action.

The injector head 200 preferably includes a number of sensors which are coupled to the control unit 170 for providing information about selected injector head operating parameter. The injector head 200 preferably contains a speed sensor 270 for determining the rotational speed of the injector head, which correlates to the speed at which the injector head 200 should be moving the tubing 142. As noted earlier, the control system determines the actual tubing speed from the sensor 162 (FIG. 1), which may be placed near the injector head as shown by sensor 162'. A sensor 273 is provided to determine the size "d" of the opening between the injector head Y-blocks. Additional sensors are provided to determine the chain tension and the radial pressure or force applied to the tubing by the Y-blocks.

The control unit 170 is coupled to the various sensors and control valves in the rig 100 and it controls the operation of the rig, including that of the injector head 200 and the blowout preventor 118 according to programmed instructions. Prior to operating the rig 100, an operator enters into the control unit 170 information about various elements of the system, such as the size of the tubing and limits of certain parameters, such as the maximum tubing speed, the maximum difference allowed between the actual tubing speed obtained from the sensor 162 or 162' and the tubing speed determined from the injector head speed sensor 270. The control unit 170 also continually determines the tension on the chains 211*a* and 211*b*, and the radial pressure on the tubing.

To operate the rig 100, an operator provides as inputs to the control unit 170 the maximum outside dimension of the bottomhole assembly, the size of the tubing to be utilized, the limits or ranges for the radial pressure that may be exerted on the tubing 142, the maximum difference between the actual tubing speed and the injector head speed and limits relating to other parameters to be controlled. An end of the tubing 142 is passed over the guide arch 144 and held in place above the working platform 130. An operator attaches the bottomhole assembly of the desired downhole equipment to the tubing end. The RAMS are then operated to provide an opening 272 in the injector head 200 that is sufficient to pass the bottomhole assembly therethrough. After inserting the bottomhole assembly into the wellhead equipment, the control unit 170 can automatically operate the injector head 200 based on the programmed instruction for the parameters as input by the operator. In one mode, the system may be operated wherein the control unit inserts the tubing 142 at a predetermined speed and maintains the radial pressure on the tubing within predetermined limits. If a slippage of the tubing through the injector head is detected, such as when it is determined that the actual speed of the tubing is greater than the speed of the injector head, then the control unit 170 causes the RAMS to exert additional pressure on the tubing to provide greater gripping force to the blocks 242*b*. If the slippage continues even after the gripping force has reached the maximum limit defined for the tubing and the back tension on the tubing is within a desired range, the control unit may 170 be programmed to activate an alarm and/or to shut down the operation until the problem is resolved.

With respect to the operation of the injector head 200, during normal operation when the tubing is inserted into the wellbore, the control unit 170 continually maintains the tubing speed, tension on the chains 211*a–b* and radial pressure on the tubing within predetermined limits provided to the control unit 170. Additionally, the control unit 170 maintains the back tension on the reel 180 and the position of the tubing guidance system within their respective predetermined limits. The control unit 170 also controls the operation of the wellhead equipment 118. During removal of the tubing from the wellbore, the control unit 170 operates the reel 180 and the injector head 200 to remove the tubing from the wellbore. Thus, in one mode of operation, the system of the invention automatically perform s the tubing injection and removal operations for the specified tubing used according to programmed instruction.

The rig system of the present invention requires substantially less manpower to operate in contrast to comparable conventional rigs. The bottomhole assembly is safely connected to the tubing at a working platform 130 prior to inserting the bottomhole assembly in t o the injector head and disconnected after the bottomhole assembly has been safely removed from the wellbore to the working platform above the injector head without requiring human intervention to move either the tubing guidance system 140 or the injector head 200 as required in the prior art systems. The injector head 200 is fixed above the wellhead equipment 118, which is safer compared to the systems which require moving the injector head. Substantially all of the operation is performed from the control unit 170 which is conveniently located at a safe distance from the rig frame 112, thus providing a relatively safer working environment. The operations are automated, thereby requiring substantially fewer persons to operate the rig system.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A tubing injection apparatus for use in oilfield wellbore operations, comprising:

(a) an injector head moving a tubular member in a substantially vertical direction through an adjustable opening in the injector head;

(b) a ram system coupled to the injector head controlling the opening and providing a predetermined gripping force to the injector head for securely gripping the tubular member; and (c) an electrical control system controlling the ram system to adjust the opening and to provide the predetermined gripping force to the injector head, the electrical control system including a sensor for determining a parameter relating the operation of the tubing injection system.

2. The apparatus as specified in claim 1, wherein the ram system is actuated by a pressurized fluid that is controlled by the electrical control system.

3. The apparatus as specified in claim 2, wherein the electrical control system includes an electrically-controlled valve coupled to the ram system for controlling flow of the pressurized fluid to the ram system.

4. The apparatus as specified in claim 1, wherein the sensor is selected from a group consisting of (a) a sensor for determining the speed of the tubular member passing through the adjustable opening in the injector head, (b) a sensor for determining a rotational speed of the injector head, (c) a sensor for determining back tension on the tubular member (d) a sensor for determining radial pressure on the tubular member, (e) a sensor for determining size of the adjustable opening, (f) a pressure sensor, and (g) a temperature sensor.

5. The apparatus as specified in claim 1, wherein the sensor determines the weight of the tubular member.

6. The apparatus as specified in claim 1, wherein the injector head includes two continuously movable members positioned opposite each other and spaced apart to define the opening in the injector head, each such movable member having connected thereto a plurality of holding blocks for gripping the tubular member when the predetermined gripping force is applied to the movable members.

7. The apparatus as specified in claim 6, wherein the sensor is selected from a group consisting of (a) a sensor for determining the speed of a movable members and, (b) a sensor for determining the tension on a movable member.

8. The apparatus as specified in claim 7, wherein the electrical control system increases the gripping force on the movable members when the speed of the tubular member is greater than the speed of the movable members.

9. The apparatus as specified in claim 8, wherein the electrical control system shuts down the operation of the injector head when the speed of the tubular member exceeds that of the movable members by a predetermined value.

10. The apparatus as specified in claim 6, wherein each holding block includes a resilient member associated therewith for providing flexibility of movement of the holding block when engaging the tubular member.

11. The apparatus as specified in claim 10, wherein each of the movable members includes a continuous motion chain.

12. The apparatus as specified in claim 11, wherein the ram system contains at least one pressurized-fluid-actuated ram and wherein each of the movable members is movably mounted on a respective backing member, with the ram controlling the opening between the movable members.

13. The apparatus as specified in claim 12, wherein the movable members are adapted to open at least twelve inches apart.

14. A tubing injection apparatus for use in wellbore operations, comprising:

(a) an injector head placed on a first platform, the injector head having:

(i) at least two movable members having holding blocks for gripping a tubular member in an opening of adjustable width between the holding blocks and for moving the tubular member in a substantially vertical direction, and (ii) a ram coupled to the injector head for adjusting the width of the opening between the holding blocks and for providing a predetermined gripping force to the holding blocks for securely gripping the tubular member, (b) a guide positioned above the injector head for directing the tubing into the injector head opening, said guide adjustable mounted above the injector head for adjusting the height of the guide above the injector head; and (c) an electrical control system controlling the ram to adjust the opening and to provide the predetermined gripping force to the injector head.

15. The tubing injection apparatus as specified in claim 14, wherein the guide moves as a function of the weight on the guide.

16. The tubing injection system as specified in claim 14, wherein the electrical control system includes a sensor associated with the guide for determining the vertical position of the guide.

17. The tubing injection system as specified in claim 16, wherein the tubular member is a coiled tubing spooled on a reel.

18. The tubing injection system as specified in claim 14, wherein the electrical control system includes a sensor for monitoring tension on the tubular member.

19. The tubing injection system as specified in claim 14, wherein the electrical control system includes a sensor selected from a group of sensors consisting of (a) a sensor for determining the speed of the tubular member passing through the opening in the injector head, (b) a sensor for determining radial force on the tubular member, and (c) a sensor for determining back tension on the tubular member.

20. The tubing injection system as specified in claim 14, wherein the electrical control system includes an electrically-controlled valve for controlling flow of fluid to the ram.

21. The tubing injection system as specified in claim 20, wherein the electrical control system controls valves for controlling flow of fluid under pressure to control the operation of the ram.

22. The tubing injection system as specified in claim 14, wherein the electrical control system includes a sensor for determining the weight of the tubular member.

23. The tubing injection system as specified in claim 14, wherein the injector head includes two continuously movable members positioned opposite each other and spaced apart to define the opening in the injector head, each such movable member having connected thereto a plurality of holding blocks for gripping the tubular member and for applying the predetermined force on the movable members.

24. The tubing injection system as specified in claim 23, wherein the electrical control system includes a sensor selected from a group consisting of (a) a sensor for determining the speed of the movable members, and (b) a sensor for determining tension on the movable members.

25. The tubing injection system as specified in claim 24, wherein the electrical control system increases the gripping force on the movable members when the speed of the tubular member is greater than the speed of the movable members.

26. The tubing injection system as specified in claim 25, wherein the electrical control system shuts down the operation of the injector head when the speed of the tubular member exceeds that of the movable members by a predetermined value.

27. The tubing injection system as specified in claim 23, wherein each holding block includes a resilient member associated therewith for providing flexibility of movement of the holding block when engaging the tubing.

28. The tubing injection system as specified in claim 27, wherein the injector head includes two continuously movable members positioned opposite each other and spaced apart to define the opening in the injector head, each such movable member having connected thereto a plurality of spaced holding blocks for gripping the tubular member when the predetermined gripping force is applied to the movable members.

29. The tubing injection system as specified in claim 28, wherein the ram system contains at least one ram and wherein each of the movable members is slidably coupled to a stationary member in a manner that allows the ram member to control the opening between the movable members.

* * * * *